US010040651B2

(12) United States Patent
Satake

(10) Patent No.: US 10,040,651 B2
(45) Date of Patent: Aug. 7, 2018

(54) SHEET FEEDING APPARATUS

(71) Applicant: Koji Satake, Yamanashi-ken (JP)

(72) Inventor: Koji Satake, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 15/419,456

(22) Filed: Jan. 30, 2017

(65) Prior Publication Data

US 2017/0217708 A1 Aug. 3, 2017

(30) Foreign Application Priority Data

Feb. 1, 2016 (JP) ..... 2016-017296

(51) Int. Cl.

| | |
|---|---|
| ***B65H 3/52*** | (2006.01) |
| ***B65H 7/12*** | (2006.01) |
| ***B65H 3/06*** | (2006.01) |
| ***B65H 7/18*** | (2006.01) |
| ***B65H 5/06*** | (2006.01) |

(52) U.S. Cl.

CPC ..... *B65H 3/5261* (2013.01); *B65H 3/06* (2013.01); *B65H 3/0607* (2013.01); *B65H 5/062* (2013.01); *B65H 7/12* (2013.01); *B65H 7/18* (2013.01); *B65H 2511/524* (2013.01)

(58) Field of Classification Search

CPC .... B65H 5/062; B65H 3/0669; B65H 3/5261; B65H 7/12; B65H 7/18; B65H 2301/42344; B65H 2301/42346

See application file for complete search history.

(56) References Cited

U.S. PATENT DOCUMENTS

| | | | | |
|---|---|---|---|---|
| 6,672,579 | B2 * | 1/2004 | Araki | B65H 3/0669 271/121 |
| 7,726,645 | B2 * | 6/2010 | Gerlier | B65H 1/04 271/121 |
| 7,905,484 | B2 * | 3/2011 | Komuro | B65H 3/0684 271/10.03 |
| 8,777,220 | B2 * | 7/2014 | Oshiro | B65H 3/0684 271/122 |
| 2013/0221602 | A1 * | 8/2013 | Walsh | B65H 3/0669 271/10.11 |
| 2016/0221772 | A1 * | 8/2016 | Ishida | B65H 1/266 |

FOREIGN PATENT DOCUMENTS

| | | | |
|---|---|---|---|
| JP | H09-175678 | A | 7/1997 |
| JP | 2005-324898 | A | 11/2005 |
| JP | 2010-120740 | A | 6/2010 |

* cited by examiner

*Primary Examiner* — Patrick D Cicchino
(74) *Attorney, Agent, or Firm* — Manabu Kanesaka

(57) ABSTRACT

A sheet feeding apparatus is provided with a pick-up roller that contacts sheets loaded on a load tray to pick up, a paper feed roller that feeds a picked-up sheet, and a separation roller brought into press-contact with the paper feed roller to separate the sheet, where the sheets are separated from the pick-up roller, the separation roller is rotated in a sheet return direction different from a sheet feed direction, and subsequently, the paper feed roller is separated from the separation roller. It is possible to prevent damage to a sheet and sheet jam from occurring in pulling out the load tray loaded with sheets to the front side.

2 Claims, 10 Drawing Sheets

SHEET FEEDING APPARATUS

BACKGROUND OF THE INVENTION

1. Field of the Invention

The present invention relates to a sheet feeding apparatus for feeding sheets to an image formation apparatus such as a copier and printer.

2. Description of Related Arts

Conventionally, sheet feeding apparatuses have been known which feed sheets to an image formation section of an image formation apparatus such as a copier and printer. A general sheet feeding apparatus is provided with a load section on which sheets are loaded. The load section is provided with a paper feed cassette capable of storing about 100 sheets, or is provided with a storage cabinet capable of storing a large amount of sheets up to a few thousand sheets.

The paper feed cassette and storage cabinet in the sheet feeding apparatus are configured so that a user is capable of pulling out to add sheets. In this pull-out mechanism, rails are installed on right and left side faces of the storage cabinet, and the paper feed cassette and storage cabinet shift along the rails.

In the sheet feeding apparatus is provided a paper feed section provided with a pick-up roller that picks up sheets on a load tray, a separation mechanism that separates sheets on a sheet-by-sheet basis, and a transport roller pair that transports the separated sheet to the image formation apparatus. Then, the sheet on the load tray is guided to the image formation apparatus along a paper feed path, by the pick-up roller, separation mechanism, and transport roller pair. As the separation mechanism, a friction separation scheme is widely known which is comprised of a paper feed roller that rotates in a feed direction of the sheet, and a separation roller that is brought into press-contact with the paper feed roller and that rotates in a direction opposite to the feed direction via a torque limiter.

In such a sheet feeding apparatus, when the cassette or the storage cabinet is pulled out with a front end of the sheet nipped by the paper feed roller and the separation roller, the sheet is left inside the sheet feeding apparatus, and there is a problem that a sheet jam and damage to the sheet occurs. In order to prevent the sheet jam and damage to the sheet from occurring, in Japanese Patent Application Publication No. H09-175678 is disclosed a lever-shaped return member that pushes back the sheet onto the load tray in conjunction with operation of separating the separation roller from the paper feed roller.

However, in the configuration where the sheet is returned onto the load tray using the lever-shaped return member as in Japanese Patent Application Publication No. H09-175678, when the front end of the sheet halts on the downstream side in the feed direction from the nip position of the paper feed roller and the separation roller, it is not possible to return the sheet. In other words, when the cassette or the storage cabinet is pulled out with the front end of the sheet halted on the downstream side in the feed direction from the nip position of the paper feed roller and the separation roller, the problem arises that damage to the sheet occurs, and that the sheet jam occurs.

SUMMARY OF THE INVENTION

A sheet feeding apparatus for feeding sheets is provided with a load tray to load sheets, a pick-up roller that contacts sheets loaded on the load tray to pick up, a paper feed roller that feeds a picked-up sheet, a separation roller brought into press-contact with the paper feed roller to separate the sheet, a drive section that rotates the separation roller, a separation/contact section which brings and separates the sheets on the load tray into contact with/from the pick-up roller, a separation section which brings and separates the paper feed roller into press-contact with/from the separation roller, and a control section that executes sheet return operation for separating the paper feed roller from the separation roller by the separation section, after separating the sheets from the pick-up roller by the separation/contact section, and rotating the separation roller in a sheet return direction different from a sheet feed direction by the drive section.

DETAILED DESCRIPTION OF THE PREFERRED EMBODIMENT

Figure 1:
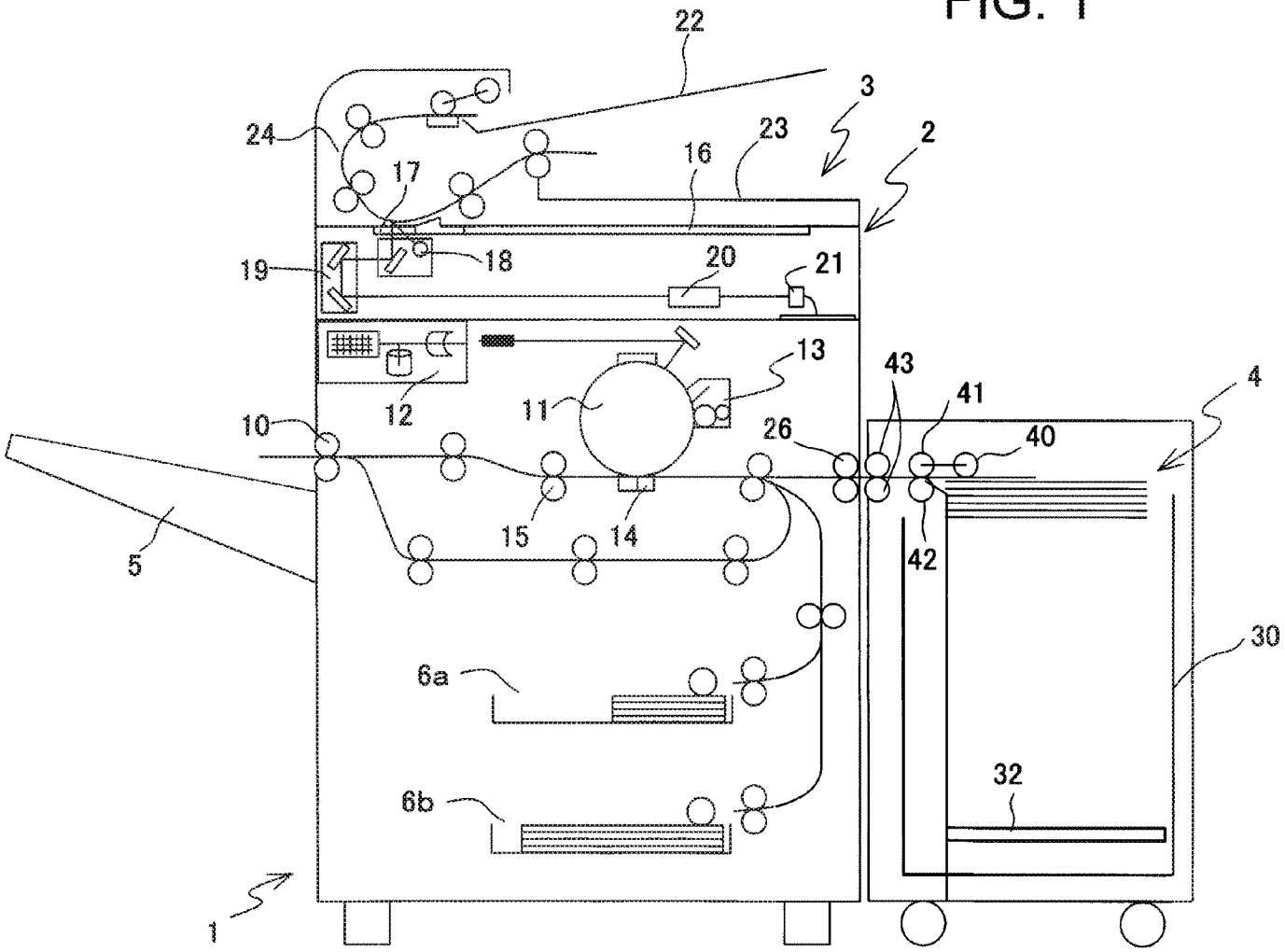
FIG. 1 is a view illustrating an entire configuration of an image formation system provided with a sheet feeding apparatus according to the present invention.

FIG. 1 is a view illustrating an entire configuration of an image formation system provided with a sheet feeding apparatus. As shown in FIG. 1, the image formation system is comprised of an image formation apparatus 1 that prints an image on a sheet, an original document read apparatus 2 that reads an original document, an original document feeding apparatus 3 that transports a sheet to a read section of the original document read apparatus 2, a sheet feeding apparatus 4 that supplies a sheet to the image formation apparatus 1, and a sheet collection apparatus 5 coupled to a sheet discharge outlet of the image formation apparatus 1 to collect sheets discharged from the image formation apparatus 1.

The image formation apparatus 1 is provided with two paper feed cassettes 6*a*, 6*b* capable of storing about 100 sheets. Then, a sheet is taken out of one of two paper feed cassettes 6*a*, 6*b* and sheet feeding apparatus 4, image data transferred from the original document read apparatus 2 is printed on the taken sheet, and the sheet is discharged to the sheet collection apparatus 5 by a sheet discharge roller pair 10.

The image formation apparatus 1 is to perform electrostatic printing, and is provided with a beam projector 12 that forms an electrostatic latent image on a photoconductor drum 11, a development device 13 that adds toner ink to the electrostatic latent image, and a transfer charger 14. Then, it is configured that the image ink formed on the photoconductor drum 11 is transferred by the transfer charger 14, and that the image on the sheet is fused by a fuser roller 15 disposed on the downstream side thereof and is transported to the sheet collection apparatus 5.

The sheet feeding apparatus 4 is provided with a storage section (storage cabinet) 30 capable of storing 3,000 sheets more than in the paper feed cassettes 6*a*, 6*b*, and supplies sheets to the image formation apparatus 1 on a sheet-by-sheet basis according to a paper feed command from the image formation apparatus 1.

In the original document read apparatus 2, above the apparatus are parallel provided first platen 16 and second platen 17 formed of transparent glass in the horizontal direction. The first platen 16 is used in reading an original document set manually, and is formed in usable original document maximum size. Then, the second platen 17 is used in reading an original document traveling at a predetermined velocity. The image read apparatus 2 is provided its inside with first and second read carriages 18, 19, and a photoelectric conversion section having a condenser lens 20 and photoelectric conversion element 21 (CCD). The first and second read carriages 18, 19 are driven by a carriage motor not shown, shift and reciprocate in the sub-scanning direction below the first platen 16. The first read carriage 18 is provided with a lamp that applies light to an original document, and a mirror that reflects the light reflected from the original document, and the second read carriage 19 is provided with two mirrors that guide the light from the mirror of the first read carriage 18 to the condenser lens 20 and photoelectric conversion element 21. Then, the first and second read carriages 18, 19 shift to apply light to the original document set on the first platen 16, and perform photoelectric conversion on the reflected light from the original document with the photoelectric conversion element 21 to read the original document. Then, image data of the original document read by the photoelectric conversion element 21 is sent to the beam projector 12 of the image formation apparatus 1 as an image signal.

The original document feeding apparatus 3 passes the original document set on a paper feed tray 22 through the second platen 17 by a sheet transport mechanism 24 to discharge to a sheet discharge tray 23. In addition, in the case of reading the original document passing over the second platen 17 by the original document feeding apparatus 3, the first and second read carriages 18, 19 are rested below the second platen 17, and read the shifting original document.

Figure 2:
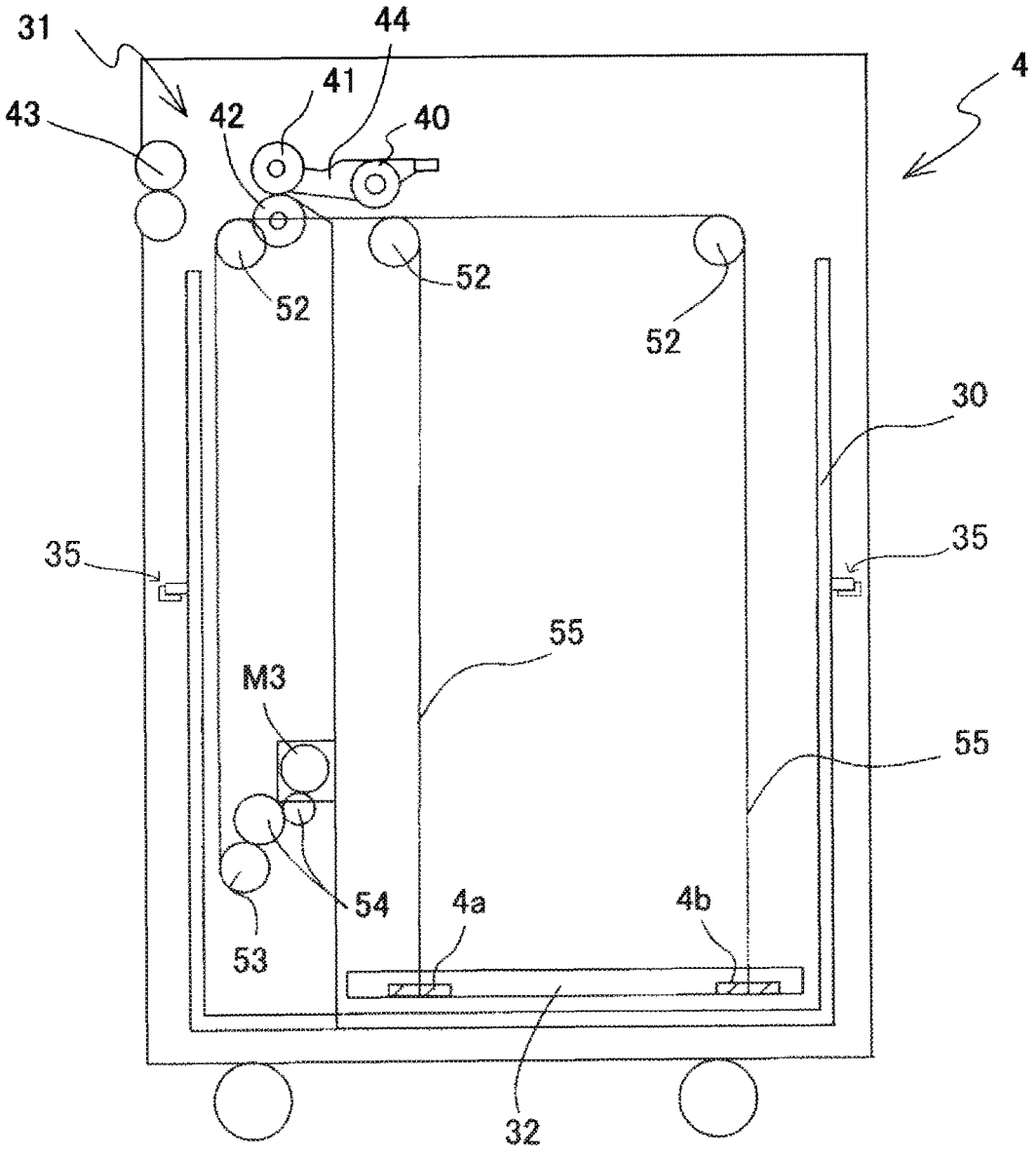
FIG. 2 is a cross-sectional view illustrating the sheet feeding apparatus according to the invention.

FIG. 2 is a cross-sectional view illustrating the sheet feeding apparatus 4. As shown in FIG. 2, the sheet feeding apparatus 4 is provided with a storage cabinet 30 (load unit) that is pulled out to set sheets, and a paper feed mechanism 31 that feeds sheets inside the storage cabinet 30. A large amount of sheets are collected in the storage cabinet 30, and the cabinet 30 is provided with a load tray 32 that moves up and down in the vertical direction, and an up-and-down mechanism for moving the load tray up and down.

The storage cabinet 30 is configured so that a user is capable of pulling out toward the front side (direction crossing the sheet feed direction) of the sheet feeding apparatus 4 as in the configuration shown in the conventional technique. Rails (guide members) are installed on right and left side faces of the storage cabinet 30, and the storage cabinet 30 shifts along the rails, and is pulled out.

The load tray 32 is a board-shaped plate to load sheets stored inside the storage cabinet 30. The load tray 32 is supported by the up-and-down mechanism provided with an up-and-down motor M3, and loaded sheets are moved up and down in an approximately horizontal state by drive of the up-and-down mechanism.

As shown in FIG. 2, the up-and-down mechanism is comprised of four wires 55 fixed to four support portions 4*a*, 4*b* provided on opposite side portions of the load tray 32, a plurality of pulleys 52 over which four wires 55 are respectively looped, four wind-up pulleys 53 attached to the same shaft to wind up four wires 55, a plurality of drive gears 54 to drive two wind-up pulleys 53, and the up-and-down motor M3 that drives the wind-up pulleys 53 via the drive gears 54. Then, the four wind-up pulleys 53 rotate by driving the up-and-down motor M3 forward, and wind up respective wires 55. By this means, the four support portions 4*a*, 4*b* of the load tray 32 are concurrently pulled up, and the load tray 32 rises, while maintaining the approximately horizontal state. On the other hand, when the up-and-down motor M3 is driven backward, the wind-up pulleys 53 are driven to rotate in the opposite direction, and the load tray moves down under its own weight.

In addition, the figure shows two support portions 4*a*, 4*b*, two wires 55, a plurality of pulleys 52 and wind-up pulley 53 on the front side, and also on the rear side are provided the support portions 4*a*, 4*b*, wires 55, pulleys 52 and wind-up pulley 53 with the similar configurations.

The paper feed mechanism 31 is provided with a pick-up roller 40 that contacts the uppermost surface of loaded sheets to feed out sheets, a separation section that separates fed sheets into a single sheet to feed, and a transport roller pair 43 that feeds the single sheet separated by the separation section to the image formation apparatus 1. The separation section is comprised of a paper feed roller 41, and a separation roller 42 brought into press-contact with the paper feed roller 41 to inhibit a sheet subsequent to the first sheet fed by the paper feed roller 41.

The pick-up roller 40 is supported by a bracket 44 swingable in the vertical direction. Then, the pick-up roller 40 is pressed against the uppermost surface loaded on the load tray 32 under its own weight. The paper feed roller 41 is drive-coupled to a paper feed motor M1 with an electromagnetic clutch CL, a plurality of gears and timing belt, and rotates by drive of the paper feed motor M1 to feed the sheet. In addition, the bracket 44 of the pick-up roller 40 is supported rotatably by the shaft of the paper feed roller 41, and it is configured that the shaft of the paper feed roller 41 is drive-coupled to the shaft of the pick-up roller 40 via a plurality of gears, and that drive of the paper feed motor M1 is drive-transferred to the pick-up roller 40 via the shaft of the paper feed roller 41.

The separation roller 42 is provided with a torque limiter (not shown) on its rotating shaft. By this means, the roller is halted when two or more sheets overlap and are nipped in a press-contact portion of the paper feed roller 41 and the separation roller 42, and inhibits feeding of second and subsequent sheets. In other words, when a plurality of sheets enters the nip portion of the paper feed roller 41 and the separation roller 42, while overlapping, the driving force of the paper feed roller 41 is transferred to the uppermost sheet, a slide occurs between the sheet and the second and subsequent sheets, and the first sheet is separated from the second and subsequent sheets.

Figure 3:
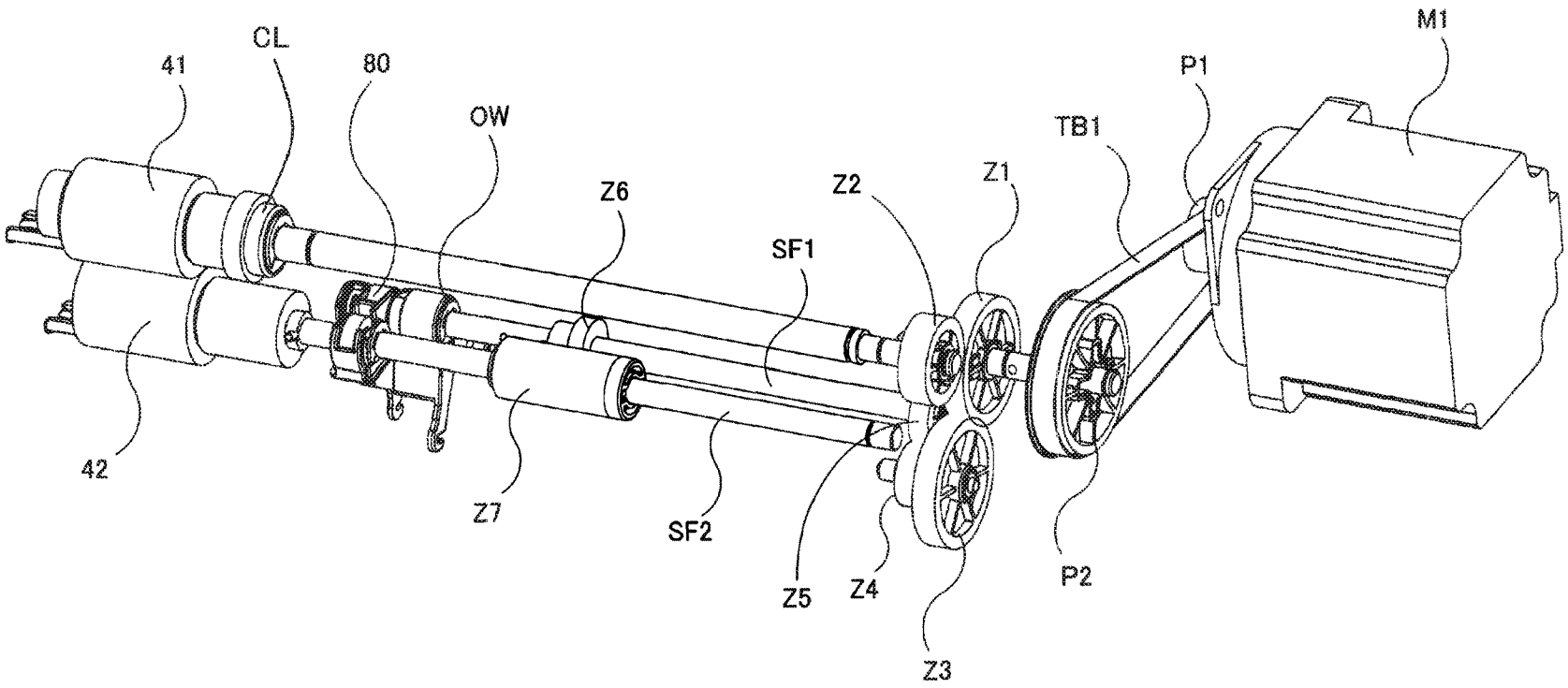
FIG. 3 is a perspective view illustrating a drive transmission mechanism of a paper feed roller and separation member of the sheet feeding apparatus according to the invention.
Figure 4:
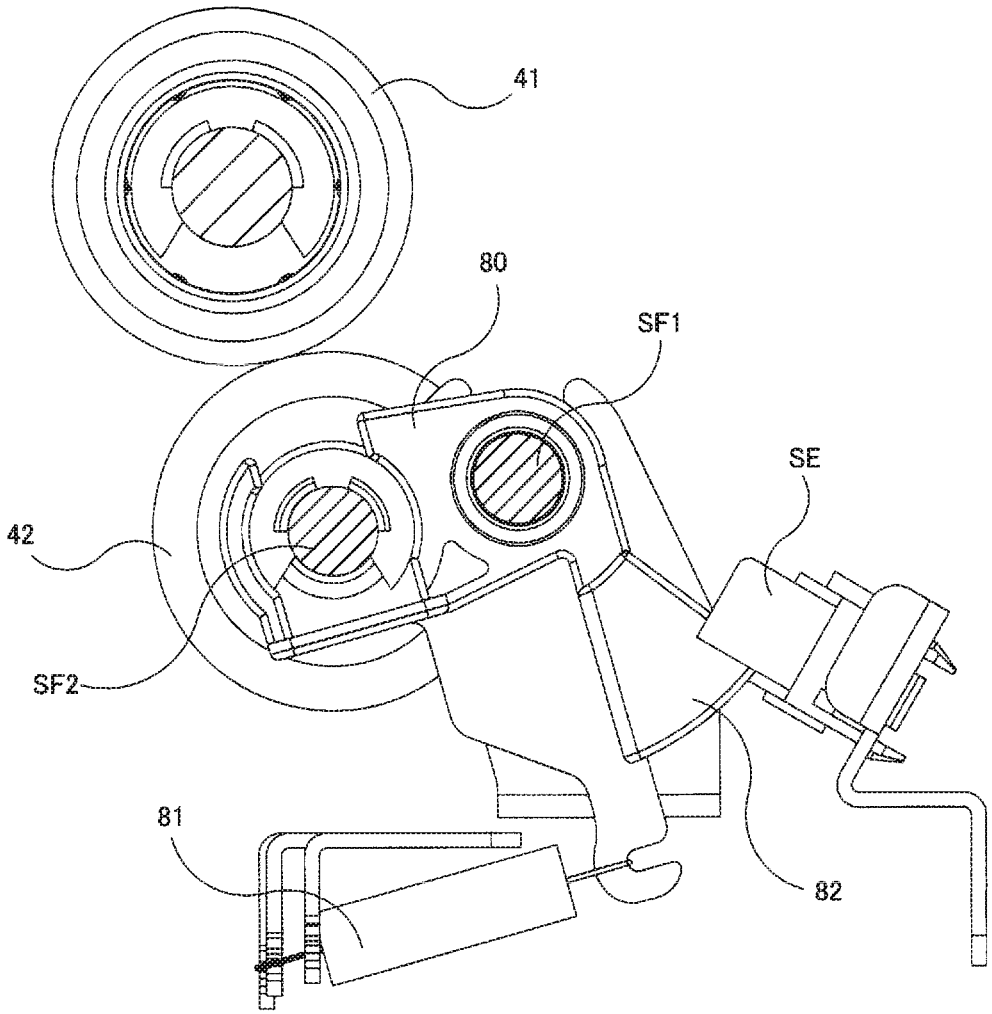
FIG. 4 is a principal-part enlarged cross-sectional view illustrating a separation section of the sheet feeding apparatus according to the invention.

FIG. 3 is a perspective view illustrating a drive transmission mechanism of the above-mentioned paper feed roller 41 and separation roller 42, and FIG. 4 is a principal-part enlarged cross-sectional view illustrating a configuration for separating the separation roller. The drive transmission mechanism of the paper feed roller 41 and the separation roller 42 will be described in detail based on FIG. 3. The drive transmission mechanism is comprised of the paper feed motor M1, a first pulley P1 provided on a drive shaft of the paper feed motor M1, a second pulley P2 paired up with the first pulley P1, a timing belt TB1 looped between the first pulley P1 and the second pulley P2, a first gear Z1 provided on the same axis as that of the second pulley P2, a second gear Z2 provided on the shaft of the paper feed roller 41 to mesh with the first gear Z1, a third gear Z3 that meshes with the first gear Z1, a fourth gear Z4 provided on the axis of the third gear Z3, a fifth gear Z5 that meshes with the fourth gear Z4 and that is provided on an intermediate shaft SF1, a sixth gear Z6 provided on the intermediate shaft SF1 of the fifth gear Z5, and a seventh gear Z7 provided on a drive shaft SF2 of the separation roller 42 to mesh with the sixth gear Z6.

By such a configuration, when the paper feed motor M1 is driven forward, drive of the paper feed motor M1 is transferred to the shaft of the paper feed roller 41 via the timing belt TB1, first gear Z1, and second gear Z2, and the paper feed roller 41 rotates in a paper feed direction (counterclockwise direction in the figure). Further, drive of the paper feed motor M1 is transferred to the intermediate shaft SF1 via the timing belt TB1, first gear Z1, third gear Z3, fourth gear Z4 and fifth gear Z5, and is transferred to the drive shaft SF2 from the intermediate shaft SF1 via the sixth gear Z6 and seventh gear Z7. Then, the separation roller rotates in the direction (clockwise direction in the figure) opposite to the paper feed direction.

The separation roller 42 is configured to be able to separate from the paper feed roller 41, and the intermediate shaft SF1 is provided with a separation lever 80 (separation means) to separate the separation roller 42 from the paper feed roller 41. As shown in FIG. 3, one end of the separation lever 80 is attached to the intermediate shaft SF1 via a one-way clutch OW, and the other end of the separation lever 80 is configured to support the drive shaft SF2 of the separation roller 42 rotatably.

Then, when the intermediate shaft SF1 is rotated in the counterclockwise direction in the figure, by backward drive of the paper feed motor M1, the separation lever 80 rotates in the counterclockwise direction on the intermediate shaft SF1 as the axis, and shifts the drive shaft SF2 and separation roller 42 in the direction for separating from the paper feed roller 41. In addition, the one-way clutch OW transfers only rotation in the counterclockwise direction of the intermediate shaft SF1 to the separation lever 80, and does not transfer rotation in the clockwise direction to the separation lever 80. In other words, the one-way clutch OW does not transfer drive for rotating the separation roller 42 in the direction opposite to the paper feed direction to the separation lever 80.

In addition, as shown in FIG. 4, the separation lever 80 is provided with a tension spring 81 to bring the separation roller 41 into press-contact with the paper feed roller 41, and a detection flag 82 to detect a position of the separation roller 42. Using a photosensor SE having a light emitting device and a light receiving device, the detection flag 82 is provided so as to release an optical path of the photosensor SE when the separation roller 42 is positioned in a press-contact position in press-contact with the paper feed roller 41, and shield the optical path when the separation roller 42 is positioned in a separate position separated from the paper feed roller 41. In other words, it is configured that the photosensor SE is OFF when the separation roller 42 is in the press-contact position, and that the photosensor SE is ON when the separation roller 42 is in the separate position, and the paper feed motor M1 is controlled according to a detection result of the photosensor SE.

Figure 5:
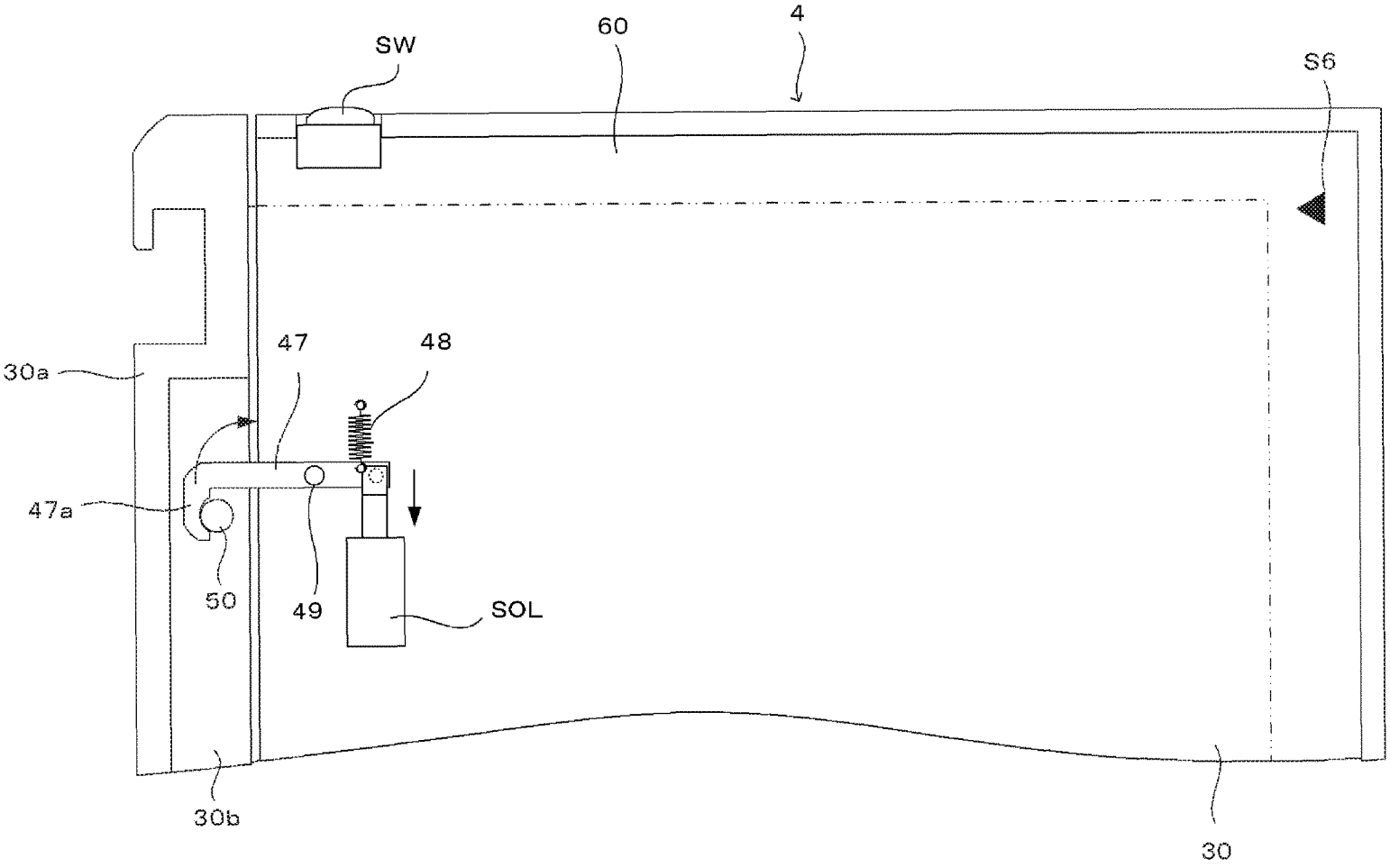
FIG. 5 is a cross-sectional view illustrating a hold mechanism that holds a storage cabinet in a storage position of the sheet feeding apparatus according to the invention.

Herein, the sheet feeding apparatus 4 is provided with a hold mechanism that holds the storage cabinet 30 in a position (storage position) stored in a frame body of the sheet feeding apparatus 4. FIG. 5 is a cross-sectional view illustrating the hold mechanism. The hold mechanism is provided in an end portion in a pull-out direction (direction shown by the arrow in FIG. 5) of the storage cabinet in the sheet feeding apparatus 4. The hold mechanism is provided with an engagement pin 50 provided on a front plate 30*b* to which is attached a front cover 30*a* of the storage cabinet 30, and an arm member 47 provided on a side plate 60 of the frame body to swing about a shaft 49 as the axis, and in the arm member 47 is formed a hook portion 47*a* that engages in the engagement pin 50. Further, the hold mechanism is provided with a biasing spring 48 that biases the hook portion 47*a* of the arm member 47 in a direction for engaging in the engagement pin 50, and a solenoid SOL that swings the hook portion 47*a* of the arm member 47 in a direction for separating from the engagement pin 50 against the biasing force of the biasing spring 48. Then, when a user presses a press button switch SW (operation member) provided on the top of the sheet feeding apparatus 4, the solenoid SOL is actuated (sucks a plunger), and the hook portion 47*a* of the arm member 47 is detached from the engagement pin 50 of the storage cabinet 30. By this means, the hold state of the storage cabinet 30 is released, and it is made possible to pull out the storage cabinet 30. On the other hand, when the storage cabinet 30 is shifted from a pulled-out position to the storage position inside the frame body of the sheet feeding apparatus 4, and a position detection sensor S6 detects the storage cabinet 30, operation of the solenoid SOL is halted (suction of the plunger is halted.) By this means, the hook portion 47*a* of the arm member 47 swings by the biasing force of the biasing spring 48, and engages in the engagement pin 50, and the storage cabinet 30 is held in the storage position.

Figure 6:
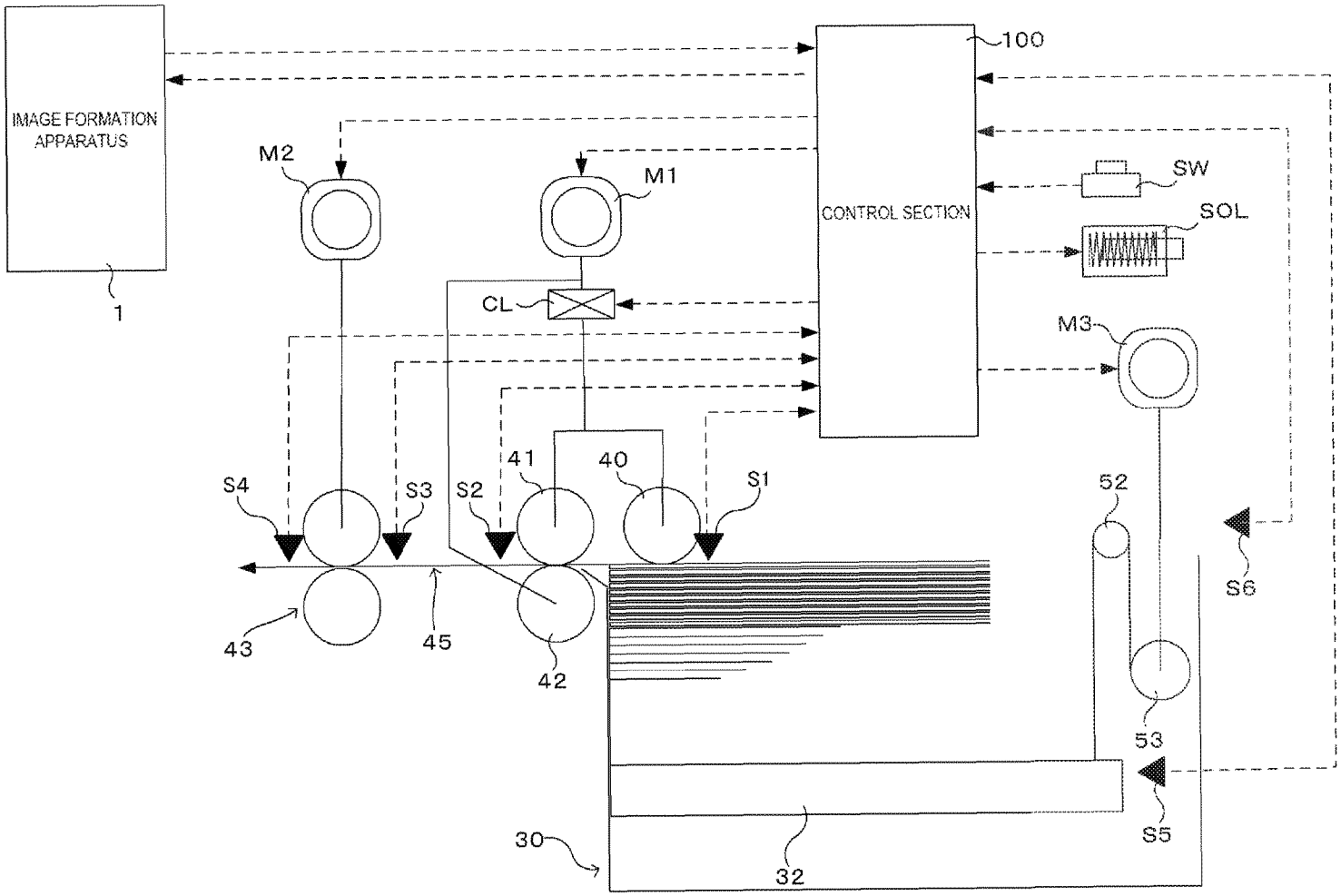
FIG. 6 is a conceptual view illustrating a control system of the sheet feeding apparatus according to the invention.

FIG. 6 is a conceptual view illustrating a control system including the sensor and actuator. As shown in FIG. 6, the sheet feeding apparatus 4 is provided with an upper limit detection sensor S1 which detects that the sheet uppermost surface arrives at a pick-up position in which the uppermost surface of sheets on the load tray 32 contacts the pick-up roller 40, a first sheet detection sensor S2 disposed immediately after the paper feed roller 41 of a paper feed path 45 for feeding a sheet to detect the sheet, a second sheet detection sensor S3 disposed between the first detection sensor S2 and the transport roller pair 43 in the paper feed path 45 to detect the sheet, a third sheet detection sensor S4 disposed immediately after the transport roller pair 43 of the paper feed path 45 to detect the sheet, and a lower limit sensor S5 which detects that the load tray 32 arrives at the lowest position. Then, as shown in the conceptual view of FIG. 5, each of sensors S1, S2, S3, S4 and S5, the position detection sensor S6 and photosensor SE described above are connected to a control section (control means) 100 including a CPU, ROM and RAM, and based on various kinds of information from the image formation apparatus 1 and detection signals from each of sensors S1, S2, S3, S4, S5, S6 and SE, the control section 100 controls drive of each of motors M1, M2 and M3 and solenoid SOL.

With respect to operation for feeding sheets, when the sheet feeding apparatus 4 receives a paper feed command from the image formation apparatus 1, the operation is started. Upon receiving the paper feed command, the paper feed motor M1 and transport motor M2 are driven to rotate forward. By this means, the pick-up roller 40, paper feed roller 41 and transport roller 43 rotate, and the sheet in the highest position on the load tray 32 is fed out by the pick-up roller 40. Then, the sheet fed out by the pick-up roller 40 is separated into a single sheet by the paper feed roller 41 and the separation roller 42. The separated sheet is supplied to the image formation apparatus 1 by the transport roller pair 43. In addition, when the sheet arrives at the transport roller pair 43, the pick-up roller 40, paper feed roller 41 and separation roller 42 are halted, and the sheet is drawn from the nip portion between the paper feed roller 41 and the separation roller 42 and is transported by the transport roller 43.

Herein, the sheet feeding apparatus 4 in this Embodiment executes sheet return operation for returning a sheet into the storage cabinet 30, so that damage to the sheet and sheet jam does not occur, in pulling out the storage cabinet 30 in a state in which the front end of the sheet passes through the nip portion between the paper feed roller 41 and the separation roller 42.

Figure 7:
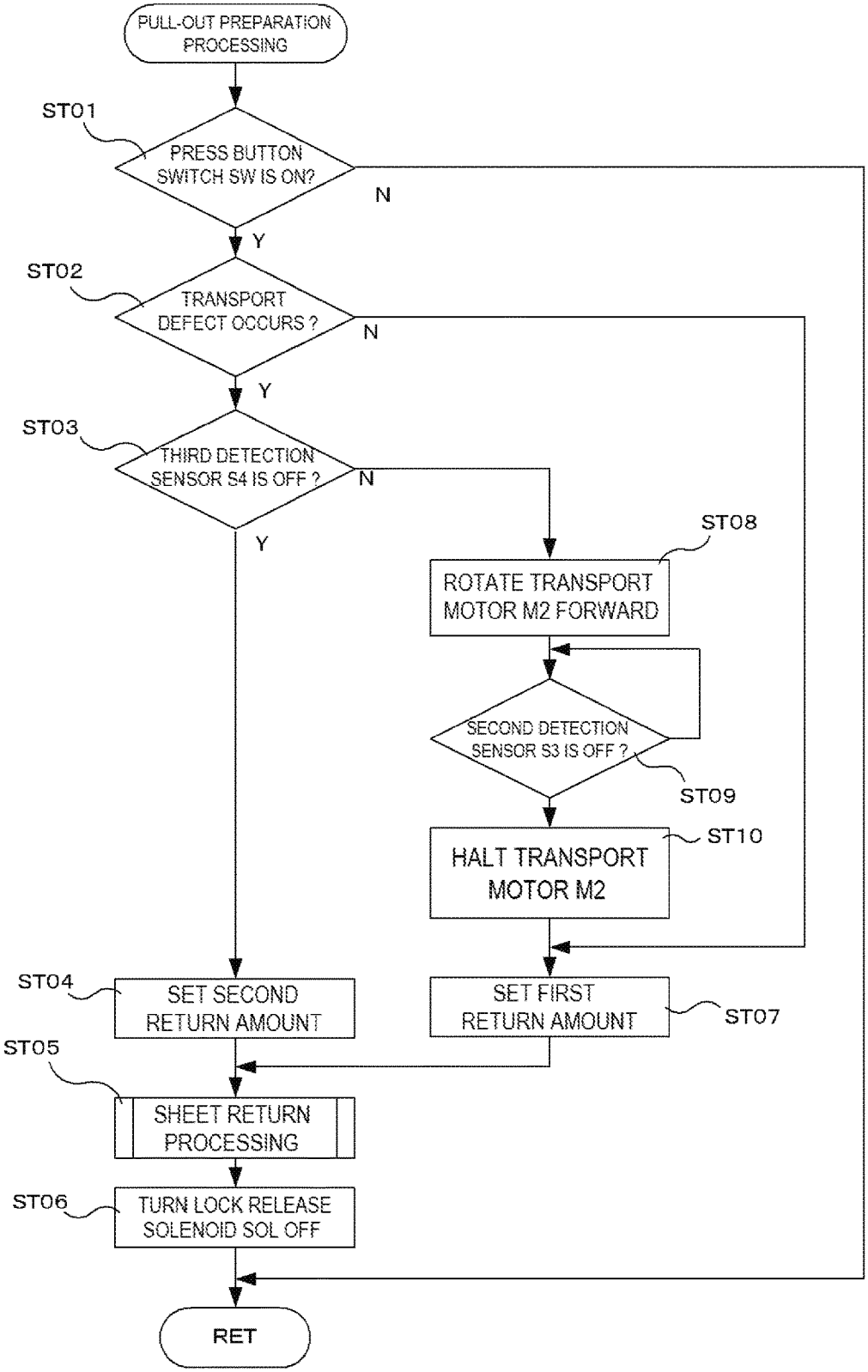
FIG. 7 is an operation flowchart diagram illustrating pull-out preparation processing and sheet return processing of the sheet feeding apparatus according to the invention.
Figure 8:
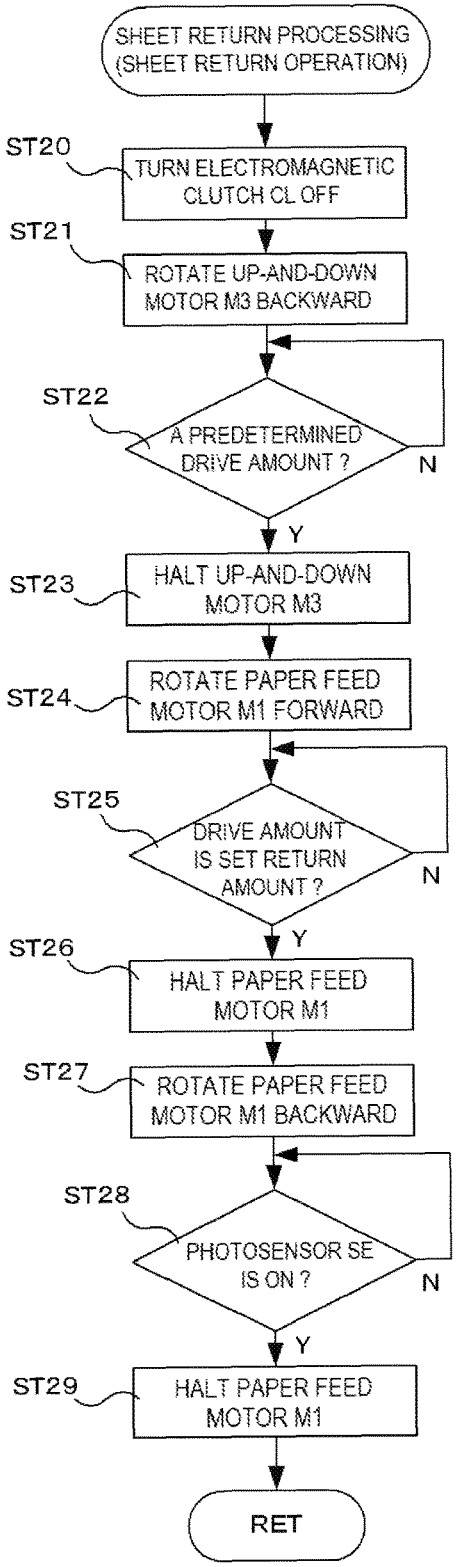
FIG. 8 is an operation flowchart diagram illustrating the sheet return processing of the sheet feeding apparatus according to the invention.

FIG. 7 is an operation flowchart diagram illustrating pull-out preparation processing executed before executing sheet return operation, and FIG. 8 is an operation flowchart diagram illustrating sheet return processing for returning a sheet into the storage cabinet 30.

Figure 9A:
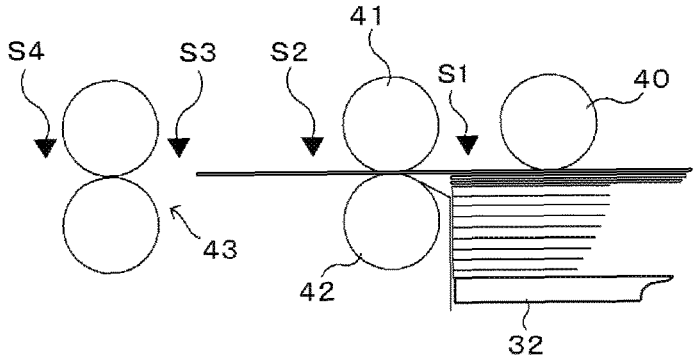
FIGS. 9A to 9D contain state views illustrating sheet return operation of the sheet feeding apparatus according to the invention.

The pull-out preparation processing is executed, when the press button switch SW provided on the top of the sheet feeding apparatus 4 is pressed (ST01). When the press button switch SW is pressed, it is first checked whether or not a transport defect occurs (ST02). When any transport defect does not occur, it is determined that the sheet feeding apparatus 4 is halted in a normal state, a return amount of the sheet is set at a first return amount, and the sheet return processing is executed (ST07, ST05). On the other hand, in the case where a transport defect occurs, when the third detection sensor S4 is OFF as shown in FIG. 9A i.e. the sheet is not detected, it is determined that the front end of the sheet does not arrive at the transport roller pair 43, the return amount of the sheet is set at a second return amount, and the sheet return processing is executed (ST03~ST05).

When the third detection sensor is ON i.e. the sheet is detected, it is determined that the front end of the sheet is in a state of passing through the transport roller pair 43, and the transport motor M2 is driven (ST08). By this means, the transport roller pair 43 rotates, and forcibly transports the sheet to the downstream side in the paper feed direction. Then, when the second detection sensor S3 is OFF i.e. the rear end of the sheet is detected, the transport motor M2 is halted (ST08~ST10). At this point, a portion on the front end side of the sheet is transported into the image formation apparatus 1, and by covering a front cover on the image formation apparatus 1 side, it is possible to remove the sheet. Subsequently, the return amount of the sheet is set at the first return amount, and the sheet return processing is executed (ST05).

When the sheet return processing is executed, the solenoid SOL is turned ON to actuate, and holding of the storage cabinet 30 is released (ST06). By this means, it is possible to pull out the storage cabinet 30.

Next, FIGS. 9A to 9D contain views illustrating state views of return operation when the sheet is halted in a state in which the third detection sensor S4 does not detect the sheet. While referring to FIGS. 9A to 9D, the sheet return operation will be described based on the operation flowchart diagram of FIG. 8.

First, the electromagnetic clutch CL is turned OFF, and the drive system of the paper feed roller 41 and pick-up roller 40 is separated from the paper feed motor M1 (ST20). Subsequently, the up-and-down motor M3 is rotated backward a predetermined amount, and is halted (ST21~ST23). By this means, the load tray 32 moves down by a predetermine amount, and the upper surface of the sheet separates from the periphery of the pick-up roller 40 (see FIGS. 9A and 9B).

After separating the upper surface of the sheet from the periphery of the pick-up roller 40, the paper feed motor M1 is driven forward (ST24). Then, after driving the paper feed motor M1 forward during a time that corresponds to the first return amount or the second return amount set in the pull-out preparation processing, the paper feed motor M1 is halted (ST25~ST26). By this means, the separation roller 42 is rotated backward in the direction of returning the sheet to the storage cabinet 30, and the sheet is returned into the storage cabinet 30 (see FIG. 9C). In addition, in returning the sheet to the storage cabinet 30, since the electromagnetic clutch CL is OFF and the paper feed roller 41 is thereby in a free state, the roller 41 follows backward rotation of the separation roller 42, and rotates backward in the direction of returning the sheet to the storage cabinet 30. Further, in this Embodiment, the first return amount is set at a return amount that corresponds to a distance two times a distance L2 from the nip position of the paper feed roller 41 and the separation roller 42 to the first detection sensor S2. Furthermore, the second return amount is set at a return amount that corresponds to a distance two times a distance L1 from the nip position of the paper feed roller 41 and the separation roller 42 to the second detection sensor S3.

In order to return the sheet into the storage cabinet 30, the separation roller 42 is rotated backward and is halted, and subsequently, the paper feed motor M1 is rotated backward in step 27 (ST27). By this means, the separation lever 80 rotates on the intermediate shaft SF1 as the axis, and shifts the separation roller 42 in the direction of separating from the paper feed roller 41. Then, when the photosensor SE is ON i.e. the detection flag 82 provided in the separation lever 80 is detected by the photosensor SE, the paper feed motor M1 is halted (ST28~ST29). By this means, the separation roller 42 shifts to a position separated from the paper feed roller 41, and is held (see FIG. 9D).

Figure 10:
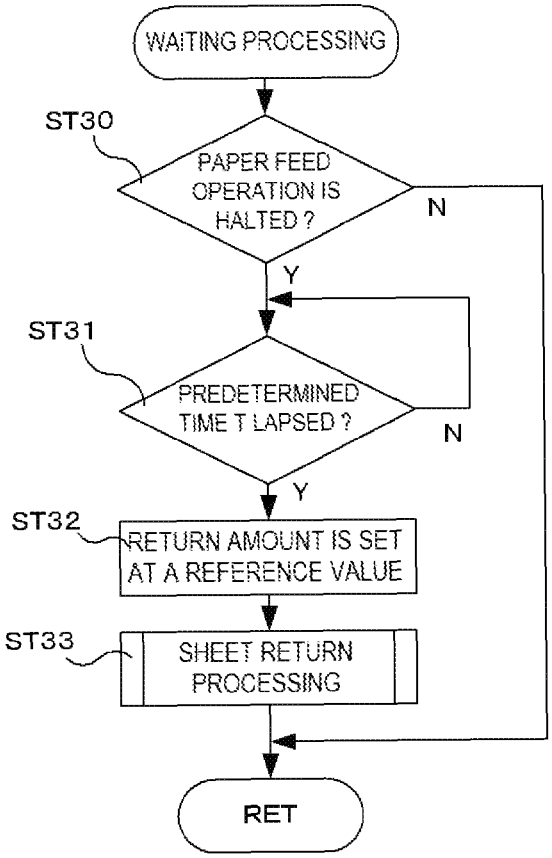
FIG. 10 is an operation flowchart diagram illustrating waiting processing of the sheet feeding apparatus according to the invention.

Next, FIG. 10 is an operation flowchart diagram illustrating waiting processing executed when the sheet feeding apparatus 4 is not operated for a long time.

In a state in which the separation roller 42 is pressed against the paper feed roller 41, by the pressing force, the separation roller 42 and paper feed roller 41 become deformed to collapse. In this deformation state, when operation of the sheet feeding apparatus 4 is halted for a long time, only a part of the roller is kept deformed and is hardened. Further, when operation of the sheet feeding apparatus 4 is halted for a long time with a sheet existing inside the paper feed path 45, a roller trace is generated in the sheet, and/or the sheet is deformed. Therefore, in this Embodiment, the above-mentioned sheet return processing is executed also when the sheet feeding apparatus 4 is halted for a long time.

As shown in the operation flowchart diagram of FIG. 10, in the waiting processing, after a lapse of predetermined time T since the paper feed operation is halted, the first return amount is set, and the above-mentioned sheet return operation is executed (ST30~ST33). Thus, since the sheet return operation is executed when the sheet feeding apparatus 4 is not used for a long time, the sheet is returned into the storage cabinet 30. By this means, it does not happen that the sheet is nipped between the paper feed roller 41 and the separation roller 42 for a long time, and it is thereby possible to prevent the roller trace to the sheet and deformation from occurring. Further, by executing the sheet return processing, since the paper feed roller 41 and the separation roller 42 are separated, it is possible to prevent the roller from being hardened, while being deformed for a long time.

In the above-mentioned Embodiment, the return amount of the sheet when the press button switch SW is pressed is set according to the presence or absence of occurrence of a transport defect in the pull-out preparation processing. Alternatively, the return amount of the sheet when the press button switch SW is pressed may be set corresponding to the front end position of the sheet, irrespective of the presence or absence of occurrence of a transport defect. Further, with respect to setting of the return amount after a lapse of predetermined time T in the waiting processing, the front end position of the sheet may be detected before setting the return amount, and the return amount may be set corresponding to the front end position of the sheet.

Figure 9B:
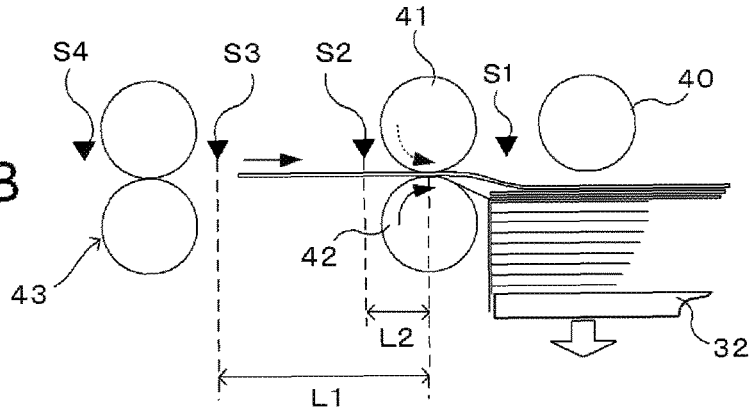
Figure 9C:
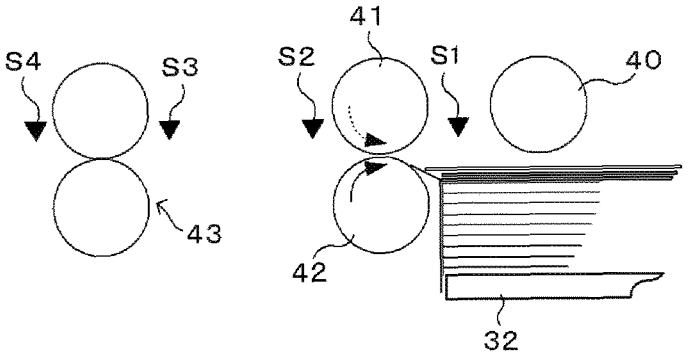
Figure 9D:
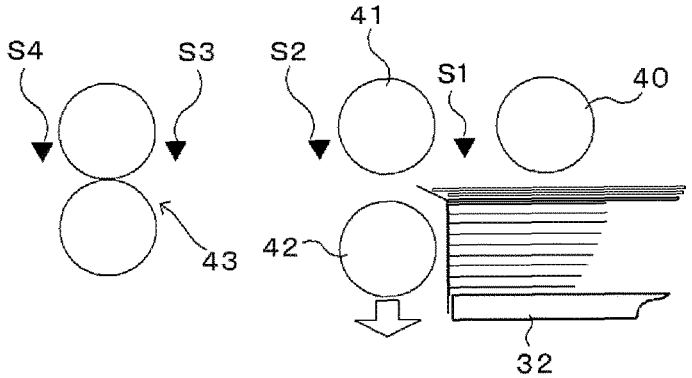

In this case, as a means for setting a return amount corresponding to the front end position of the sheet, when the first detection sensor S2 disposed in the paper feed path 45 detects a sheet, and the second detection sensor S3 does not detect the sheet, it is determined that the front end of the sheet exists between the first detection sensor S2 and the second detection sensor S3, and the return amount is set based on the distance L1 from the nip position of the paper feed roller 41 and the separation roller 42 to the second detection sensor S3 shown in FIG. 9B. On the other hand, when neither the first detection sensor S2 nor the second detection sensor S3 detects the sheet, it is determined that the front end of the sheet exists between the storage cabinet 30 and the first detection sensor S2, and the return amount is set based on the distance L2 from the nip position of the paper feed roller 41 and the separation roller 42 to the first detection sensor shown in FIG. 9B.

Further, in this Embodiment, the paper feed motor M1 rotates the paper feed roller 41 and the separation roller 40. Alternatively, the paper feed motor M1 may rotate the paper feed roller 41 and the pick-up roller 40, and a motor different from the paper feed motor M1 may rotate the separation roller 42 and separate the separation roller 42 from the paper feed roller 41.

Furthermore, in this Embodiment, in the sheet return processing, the up-and-down motor M3 is driven to move the load tray 32 down so as to separate the periphery of the pick-up roller 40 and the uppermost surface of sheets. Alternatively, the pick-up roller 40 may be moved up by a predetermined amount using an actuator such as a solenoid to separate the periphery of the pick-up roller 40 and the uppermost surface of sheets.

This application claims priority based on Japanese Patent Application No. 2016-017296 filed on Feb. 1, 2016, entire content of which is expressly incorporated by reference herein.

What is claimed is:

1. A sheet feeding apparatus for feeding sheets, comprising:

a load unit adapted to load sheets;

a guide member to shift the load unit to a first position in which the load unit is stored in an apparatus body and a second position in which the load unit is pulled out of the apparatus body;

a pick-up roller adapted to contact sheets loaded on the load unit to pick up;

a paper feed roller to feed a picked-up sheet;

a separation roller brought into press-contact with the paper feed roller to separate the sheet;

a drive motor to rotate the separation roller;

a separation/contact mechanism to bring and separate the sheet on the load unit into contact with/from the pick-up roller;

a separation mechanism to bring and separate the paper feed roller into press-contact with/from the separation roller;

a control section to execute sheet return operation for separating the paper feed roller from the separation roller by the separation mechanism, after separating the sheet from the pick-up roller by the separation/contact mechanism, and rotating the separation roller in a sheet return direction different from a sheet feed direction by the drive motor;

a hold mechanism to hold the load unit in the first position;

a release mechanism to release holding by the hold mechanism; and an operation member to execute the sheet return operation, wherein based on an operation state of the operation member, the control section executes the sheet return operation, and after executing the sheet return operation, the control section actuates the release mechanism to release the holding by the hold mechanism.

2. The sheet feeding apparatus according to claim 1, wherein the operation member is a release switch to release the holding by the hold mechanism and to shift the load unit from the first position to the second position.

* * * * *